United States Patent [19]

Chang

[11] Patent Number: 4,745,662

[45] Date of Patent: May 24, 1988

[54] EASILY ASSEMBLED CLIP

[76] Inventor: Shih-Ho Chang, No. 2-12, Chang-Lu Rd., Changhua, Taiwan

[21] Appl. No.: 58,465

[22] Filed: Jun. 5, 1987

[51] Int. Cl.[4] ..... B42F 1/00

[52] U.S. Cl. ..... 24/67.7; 24/67.1; 24/67.11

[58] Field of Search ..... 24/67.7, 67.9, 67.11, 24/67 R, 67.3, 67.1, 67.5, 271, 270, 20 S; 281/15 B

[56] References Cited

U.S. PATENT DOCUMENTS

| | | | |
|---|---|---|---|
| 314,769 | 3/1885 | Yeiser | 24/67.7 |
| 2,500,032 | 3/1950 | Helberg | 24/67.7 |
| 2,501,710 | 3/1950 | Boyer | 24/67.1 |
| 2,862,328 | 12/1958 | Wadsworth | 24/67.7 |
| 2,994,934 | 8/1961 | Kraus | 24/271 |
| 4,628,572 | 12/1986 | Chang | 24/67.11 |

*Primary Examiner*—Victor N. Sakran
*Attorney, Agent, or Firm*—Paul J. Sutton

[57] ABSTRACT

An improved clip for clamping papers has a pair of generally T-shaped clamping members each having a clamping portion and two lugs, a pivot pin for interconnecting pivotally the lugs of the clamping members, and a torsion spring mounted on the pivot pin for biasing the clamping portions of the clamping members to abut against each other. The improvement wherein an end of the pivot pin has two axially spaced annular flanges between which the pivot pin passes through a lug of a clamping member and a lug of the other clamping member. The pair of lugs disposed between the flanges are biased by the torsion spring to move in opposite directions and in turn to clamp tightly the pivot pin between the flanges, thereby preventing one of the flanges from outward movement by the obstructing action of the lugs between the flanges.

3 Claims, 4 Drawing Sheets

EASILY ASSEMBLED CLIP

BACKGROUND OF THE INVENTION

The present invention relates to a clip for clamping papers, and more particularly to one which is provided with an improved pivot pin whereby the clip can be assembled easily.

Referring to FIG. 1, a conventional clip includes a pair of generally T-shaped clamping members 10*a* and 10*b*. Each of the clamping members 10*a* and 10*b* has an elongated clamping portion 11*a*, 11*b*, a finger actuated portion 12*a*, 12*b*, and two lugs 13*a*, 13*b*, each having a hole. The clamping members 10*a* and 10*b* are connected pivotally together by a pivot pin 20. Mounted pivotally on the opposite ends of the pivot pin 20 are two pairs of adjacent lugs 13*a* and 13*b*. A torsion spring 30 mounted on the pivot pin 20 is used to bias the clamping portions 11 to abut against each other for clamping papers. In assembly, after the pivot pin 20 has been inserted through the lugs 13*a* and 13*b* and the spring 30, each end of the pivot pin 20 must be pressed to form an enlarged planar portion which can prevent the pivot pin 20 from moving off the clip. This pressing process must be achieved by a special machine or tool. In addition, because the conventional clip is difficult to assemble, the manufacturing costs are undesirably high.

SUMMARY OF THE INVENTION

It is therefore an object of the present invention to provide an improved clip which is provided with an improved pivot pin whereby the clip can be assembled easily.

According to the present invention, the improved clip includes an improved pivot pin. The improved pivot pin has an end which is provided with a pair of annular flanges spaced axially from each other at a predetermined distance for positioning a pair of adjacent lugs of the clamping members between the flanges by the biasing action of a torsion spring. The flange remoted from the end of the pivot pin is capable of passing through the pair of adjacent lugs. Thereby, in assembly, the pivot pin is forced through each of the lugs and the spring until the pair of adjacent lugs are located between the flanges. Then the spring biases the clamping portions of the clamping members to abut against each other so that the biasing force of the spring causes the pair of adjacent lugs to move in opposite directions and in turn to clamp tightly the pivot pin between the flanges. As a result, the flange remoted from the end of the pivot pin is obstructed from outward movement by the pair of adjacent lugs so that the pivot pin is positioned easily on the clip.

BRIEF DESCRIPTION OF THE DRAWINGS

Other features and advantages of the present invention will become apparent from the following detailed description of the preferred embodiment of the present invention with reference to the accompanying drawings in which.

DETAILED DESCRIPTION OF THE PREFERRED EMBODIMENT

Figure 1:
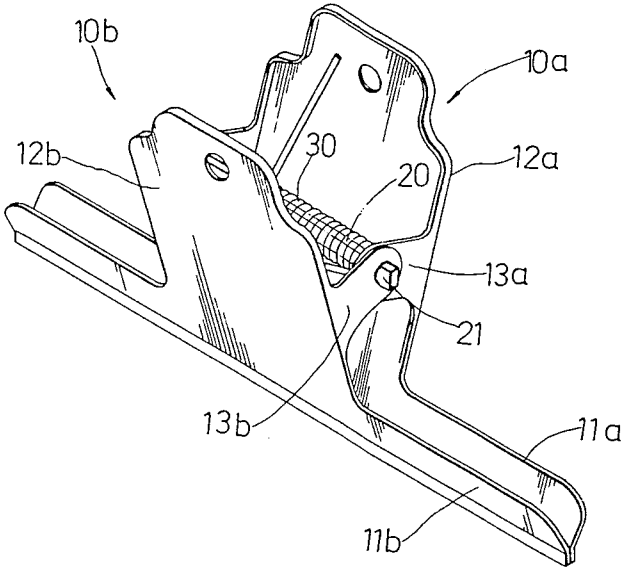
FIG. 1 PRIOR ART
FIG. 1 is a perspective view of a conventional clip.
Figure 2:
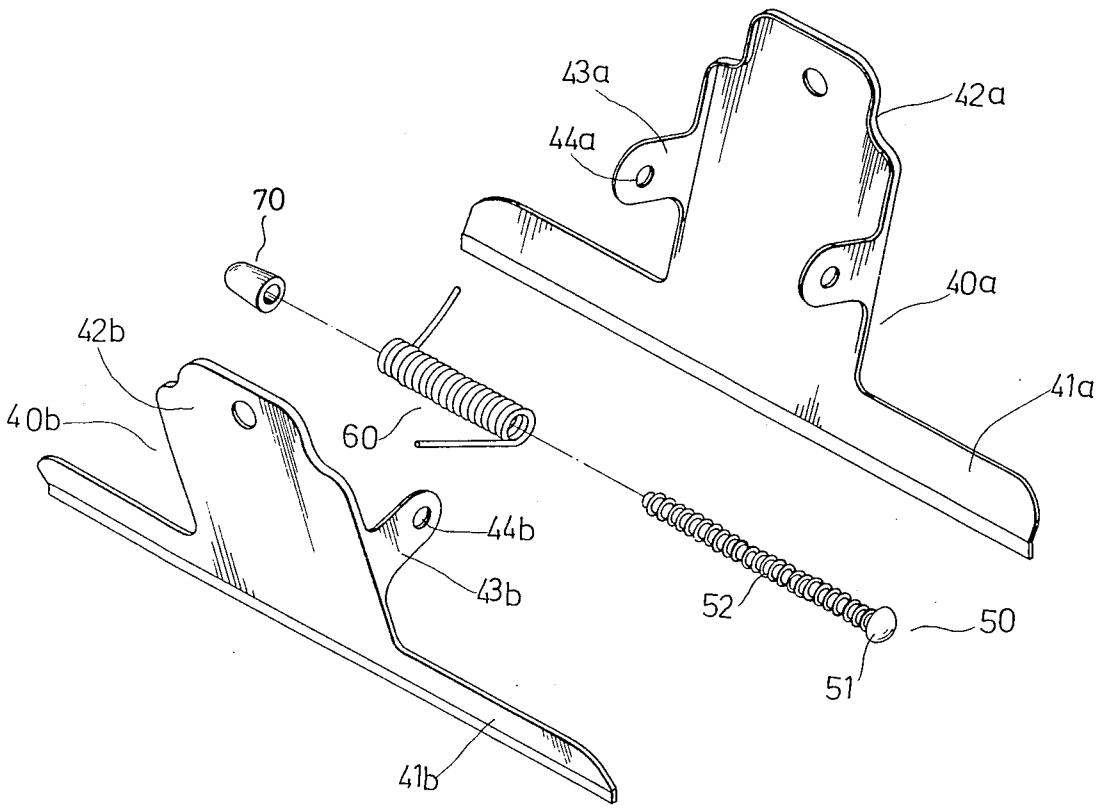
FIG. 2 is an exploded view of an improved clip according to the present invention.
Figure 3:
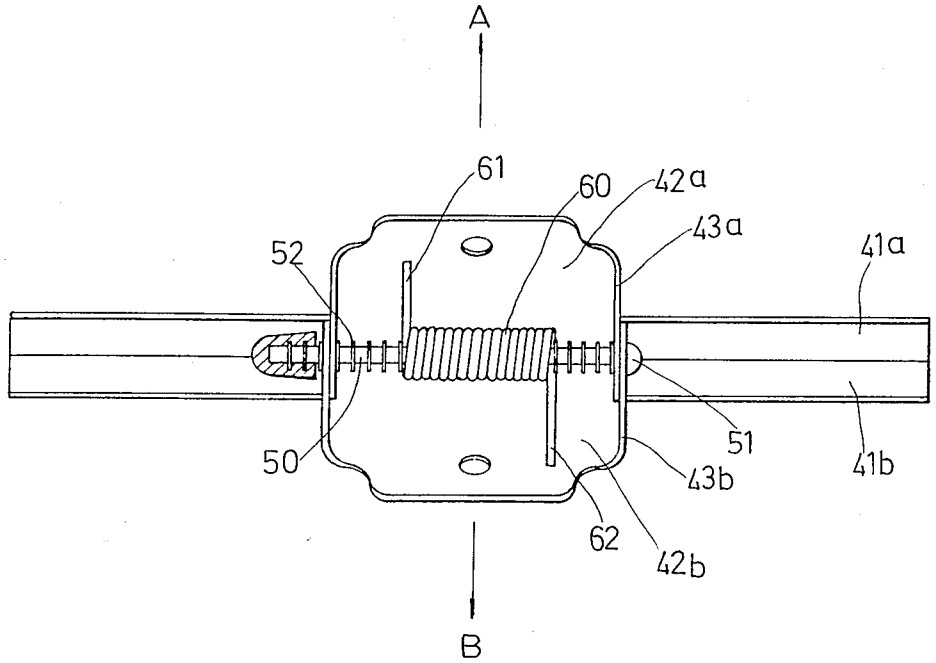
FIG. 3 is an elevational top view showing the improved clip of the present invention.
Figure 4:
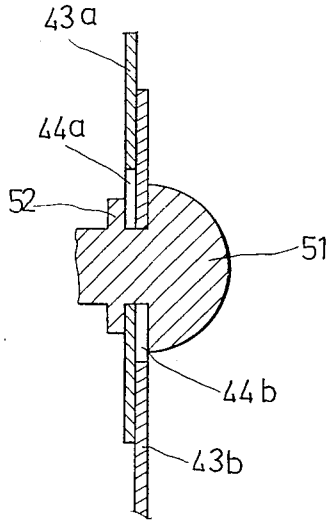
FIG. 4 is a schematic sectional view illustrating how a flange of a pivot pin is obstructed from outward movement according to the present invention.

Referring to FIG. 2 with reference to FIGS. 3 and 4, there is shown an improved clip according to the present invention. The improved clip is similar to conventional clips in construction except for an novel pivot pin. As illustrated, the clip includes a pair of generally T-shaped clamping members 40*a* and 40*b*, a pivot pin 50 for interconnecting pivotally the clamping members 40, a torsion spring 60, and a sleeve 70. Each of the clamping members 40*a*, 40*b* has an elongated clamping portion 41*a*, 41*b*, a finger actuated portion 42*a* and 42*b*, and two lugs 43 each having a hole 44*a*, 44*b*. The pivot pin 50 has an end cap 51 and a plurality of equally spaced annular flanges 52.

The clamping members 40*a* and 40*b* are similar to each other in size and construction. On the pivot pin 50, the end cap 51 is spaced from the flange 52 adjacent thereto at a distance slightly greater than the total thickness of the two adjacent lugs 43*a* and 43*b*. In addition, the diameter of the flanges 52 is smaller than that of the holes 44*a* and 44*b* for passing therethrough. While the diameter of the end cap 51 is greater than that of the holes 44*a* and 44*b*.

Referring to FIG. 3, the spring 60 is disposed on the pivot pin 50 between two pairs of adjacent lugs 43*a* and 43*b* so that the finger actuated portions 42*a* and 42*b* are biased away from each other, thereby biasing the clamping portions 41*a* and 41*b* to abut against each other. That is, the clamping portion 42*a* is biased by the first press strip 61 of the spring 60 to move in a direction A, and the clamping portion 42*b* is biased by the second press strip 62 of the spring 60 to move in a direction B.

In assembly, the end of the pivot pin 50 opposite the end cap 51 is forced through each of the holes 44*a* and 44*b* and spring 60 so that a pair of adjacent lugs 43*a* and 43*b* are positioned between the flanges 52. Then, referring to FIG. 4, the lugs 43*a* and 43*b* are biased by the spring 60 to move in opposite directions, as described above, to thereby clamp tightly the pivot pin 50. Since the flange 52 adjacent to the end cap 51 is obstructed from outward movement by the lugs 43*a* and 43*b*, the pivot pin 50 is positioned on the clip and thus can not move off the clip. This insertion process is so easy to effect that the manufacturing cost is reduced largely.

Optionally, the sleeve 70 may be sleeved on the pivot pin 50.

It is noted that the spring 60 can be positioned on the pivot pin 50 by the abutment of the remaining flanges 52 and by the biasing force of the press strips 61 and 62.

It is also noted that althrough in this embodiment the diameter of the end cap 51 of the pivot pin 50 is larger than that of the holes 44*a* and 44*b* of the lugs 43*a* and 43*b*, it may be smaller than that of the holes 44*a* and 44*b* of the lugs 43*a* and 43*b*. In this case, the lugs 43*a* and 43*b* still clamp the portion of the pivot pin 50 between the flanges 52 and the end cap 51.

Alternatively, one of the clamping members 40*a* and 40*b* may be modified with the form of a board for use in a clipboard.

With the present invention thus explained, it is apparent that various modifications and variations can be made without departing from the scope and spirit of the present invention. It is therefore intended that the present invention be limited only as indicated in the appended claims.

What is claimed is:

1. An improved clip of the type having a first clamping member and a second clamping member each of which has a clamping portion and two lugs each having a hole, a pivot pin disposed through each of said holes of said lugs of said first and second clamping members for interconnecting pivotally said lugs of said first and second clamping members, and means for biasing said clamping portions of said first and second clamping members to abut against each other for clamping papers therebetween, wherein one of said lugs of said first clamping member is positioned adjacent to one of said lugs of said second clamping member, and the other of said lugs of said first clamping member is positioned adjacent to the other of said lugs of said second clamping member, so that two pairs of adjacent lugs are formed; characterized by an end of said pivot pin including a pair of annular flanges spaced axially from each other at a distance slightly greater than the total thickness of one pair of said adjacent lugs, the diameter of one said flange remoted from said end of said pivot pin being smaller than the diameter of each of said holes of said lugs of said first and second clamping members for the insertion of said pivot pin through said holes of said lugs, whereby, when said pivot pin is forced through each of said holes of said lugs while permitting said one pair of said adjacent lugs to be positioned closely between said flanges, said one pair of said adjacent lugs are biased by said biasing means to move in opposite directions and in turn to clamp tightly said pivot pin between said flanges, thereby preventing said pivot pin from movement off the clip, said pivot pin including a plurality of equally spaced annular flanges projecting therefrom between said two pairs of said adjacent lugs for positioning said biasing means on said pivot pin.

2. An improved clip as claimed in claim 1, wherein said biasing means being a torsion spring disposed on said pivot pin between said two pair of said adjacent lugs.

3. An improved clip as claimed in claim 1, wherein the other of said flanges adjacent to said end of said pivot pin is a cap end.

* * * * *